US006027268A

United States Patent [19]

Bischel et al.

[11] Patent Number: 6,027,268

[45] Date of Patent: Feb. 22, 2000

[54] METHOD AND APPARATUS FOR REPLACING A PRINTER WITH A NEW PRINTER OF A DIFFERENT TYPE

[75] Inventors: Patrick Oscar Bischel, Paris; John Knox Brown, III, Lexington; Kathy Scott D'Alessandro, Georgetown; Edward William Yohon, Jr., Lexington, all of Ky.

[73] Assignee: Lexmark International, Inc., Lexington, Ky.

[21] Appl. No.: 09/066,139

[22] Filed: Apr. 24, 1998

[51] Int. Cl.[7] ..... B41J 11/50

[52] U.S. Cl. ..... 400/584; 400/582; 400/605; 400/624

[58] Field of Search ..... 271/9.06, 145, 271/153; 400/605, 584, 582, 624; 101/232; 399/16, 369, 370, 376, 391; 395/111

[56] References Cited

U.S. PATENT DOCUMENTS

| | | | |
|---|---|---|---|
| 4,190,246 | 2/1980 | Sasuga | 271/145 |
| 4,282,583 | 8/1981 | Khan et al. | 364/900 |
| 4,556,959 | 12/1985 | Allen et al. | 364/900 |
| 4,796,056 | 1/1989 | Ito | 355/14 |
| 4,846,597 | 7/1989 | Bryant et al. | 400/472 |
| 5,050,098 | 9/1991 | Brown, III et al. | 364/519 |
| 5,127,643 | 7/1992 | DeSanctis et al. | 271/9 |
| 5,130,757 | 7/1992 | Ito . | |
| 5,228,118 | 7/1993 | Sasaki | 395/112 |
| 5,237,379 | 8/1993 | Sklut et al. | 355/311 |
| 5,390,910 | 2/1995 | Mandel et al. | 271/296 |
| 5,457,524 | 10/1995 | Metcalf et al. | 355/309 |
| 5,502,555 | 3/1996 | Lakatos | 355/311 |
| 5,533,176 | 7/1996 | Best et al. | 395/117 |
| 5,555,435 | 9/1996 | Campbell et al. | 395/800 |
| 5,641,154 | 6/1997 | Gysling et al. | 271/9.01 |
| 5,710,968 | 1/1998 | Bischel et al. | 399/382 |
| 5,754,748 | 5/1998 | Rivers et al. . | |
| 5,816,716 | 10/1998 | Sugiyama | 400/76 |
| 5,905,906 | 5/1999 | Goffinet et al. . | |

*Primary Examiner*—John Hilten
*Assistant Examiner*—Charles H. Nolan, Jr.
*Attorney, Agent, or Firm*—John A. Brady

[57] ABSTRACT

A printing apparatus and method of use therefore are disclosed. The printing apparatus is usable as a replacement printer for replacing an existing printer apparatus without having to change printer drivers or make custom firmware changes in computers on a computer network. The inventive printer apparatus includes a map of source number assignments in the memory of the replacement printer apparatus for the replaced existing printer apparatus and for the replacement printer apparatus. The printing apparatus has a plurality of paper sources with each paper source being assigned a particular pre-assigned assignment code. The print request codes associated with the existing network printer being replaced must be determined. The print request codes are representative of a particular type of paper source. A map of print request codes which are sent by computers on the network for driving the existing printer are compared with the pre-assigned source number assignment of the replacement printer. If the pre-assigned source number assignment is different for any of the paper sources than the print request code, a user can change the source number assignment to agree with the print request code. These changes are placed into a table into the non-volatile memory of the printer, thereby creating a mapping of source number assignments for the new replacement printer, the old printer being replaced, and the custom firmware. The pre-assigned source number assignments can be changed using either NPA commands, the printing apparatus operations panel or using printer job language (PJL).

18 Claims, 7 Drawing Sheets

B

IF (ORGVAL=FAC(1)
OR
ORGVAL=FAC(2)
• • •
ORGVAL=FAC(ENV))
AND VALUE FOR MATCHING
SOURCE=NONE
180
NO
YES
WRITE TO
NON-VOLATILE
MEMORY CT(MATCHING
SOURCE)=OFF
190
IF(VALUE=FAC(1)OR
• • •
FAC(ENV) AND
CT(FACSRC(VALUE))
= OFF
200
NO
YES
WRITE TO
NON-VOLATILE MEMORY
CT(FACSRC(VALUE))=
NONE
210
C

METHOD AND APPARATUS FOR REPLACING A PRINTER WITH A NEW PRINTER OF A DIFFERENT TYPE

FIELD OF THE INVENTION

The present invention relates generally to a printing apparatus having a plurality of paper sources, with each paper source on the printing apparatus having a particular pre-assigned source number assignment associated therewith. More particularly, the present invention is directed to a method of replacing an existing printer apparatus with a replacement printer apparatus without having to change printer drivers or make custom firmware changes in external devices on a computer network. The replacement printer apparatus includes a map of source number assignments in the memory of the replacement printer apparatus for the replaced existing printer apparatus and for the replacement printer apparatus.

BACKGROUND OF THE INVENTION

Computer printers are often provided with a wide variety of paper trays or sources. The wide variety of paper sources alleviates the necessity for users to constantly have to change the paper trays. This feature is especially convenient on computer networks having multiple computers where multiple computer users may each require a different paper source.

The multiple computers each have either a printer driver or application for driving the computer printer on the network. The printer driver or application sends commands to the network printer including a command for selecting a paper source. The printer control commands are in a printer control language known as PCL. A PCL select paper feed command is used to request a particular one of the paper sources on a given printer. The parameter, i.e., number used in the PCL select paper feed command to select comparable sources often varies among printers. The use of different numbers in the PCL select paper feed commands causes problems when an existing network printer is replaced with a replacement network printer unless printer drivers or applications are changed or custom firmware changes in the printer are made. These changes are not always possible or desirable. A customer may decide not to purchase a printer if the purchase of the replacement printer requires new printer drivers to be installed. The custom firmware may be difficult to change because the programmer who created the custom firmware is no longer available, and if the firmware can be changed, it might be expensive.

An example of source number assignments for an existing printer (Hewlett-Packard Laser Jet 5Si) and for a replacement printer (Lexmark Optra S 2450) is described for a network as depicted in FIG. 1. The network N includes a computer printer P, a first computer A and a second computer B. The computer printer in this example is an Optra S 2450 model printer. Installed in computer A is a printer driver for the Hewlett-Packard Laser Jet 5Si model printer. Installed in computer B is a custom application having its own printer driver for driving the Hewlett-Packard Laser Jet 5Si model printer. For example, the Hewlett-Packard Laser Jet model printer 5Si uses the following source number assignments for the following paper sources having the listed paper capacities.

TABLE A

| Hewlett-Packard Laser Jet 5Si | | |
|---|---|---|
| Tray Number | Source Number | Capacity |
| Tray 1 | Source Number Assignment 8 | 100 |
| Tray 2 | Source Number Assignment 1 | 500 |
| Tray 3 | Source Number Assignment 4 | 500 |
| Tray 4 | Source Number Assignment 5 | 2000 |

In this example, the new replacement printer (Lexmark Optra S 2450) has the following source number assignments for the following paper sources:

TABLE B

| Lexmark Optra S 2450 | | |
|---|---|---|
| Tray Number | Number | Capacity |
| Tray 1 | Source Number Assignment 1 | 250 |
| Tray 2 | Source Number Assignment 4 | 500 |
| Tray 3 | Source Number Assignment 5 | 500 |
| Tray 4 | Source Number Assignment 20 | 2000 |

As is evident from the above tables, compatibility problems have been created because the replacement printer has different source number assignments than the existing printer being replaced. Thus, without printer driver changes, when the replacement printer receives a PCL print request code including the source number assignment, the wrong paper source would be selected. This problem has been previously addressed with a limited degree of success.

A previous known method changed source number assignments using printer job language (PJL) commands. The PJL commands modify tray renumber printer settings to change source number assignments for a paper source. The following tray renumber printer settings were used:

1) Tray 1 Renumber;

2) Multi-Purpose Feeder Renumber; and

3) Last Tray Renumber.

In this previous known method, a swap of source assignment occurs as explained below in the following example.

Last Tray Renumber Example

This example uses the last tray renumber function. The printer has optional sources Tray 2, Tray 3 and Tray 4 installed. Using a PJL command, last tray renumber is equal to Tray 3 and, as a result, the source assignments for Tray 3 and Tray 4 are swapped.

Tray 3

Tray 4

All other source assignments are unchanged. The 2000 sheet capacity source is accessed using source number 5 for both the Laser Jet 5Si and Optra S 2450.

Using Multiple Renumbering Settings

Two or more of the withdrawn settings may be used together to obtain more variations of source assignment swapping.

When more than one of the renumber settings is utilized, the order used by PCL when processing the renumber settings is relevant and must remain constant to achieve consistent results. The renumbering functions are processed in the following order.

1. Tray 1 Renumber
2. Multi-Purpose Feeder Renumber
3. Last Tray Renumber

An example of multiple renumbering using a Lexmark Optra S 1650 to replace a Hewlett-Packard Laser Jet 5 is explained below. The Hewlett-Packard Laser Jet 5 has the following source assignments for the following paper sources as listed in Table C below:

TABLE C

| Hewlett-Packard Laser Jet 5 | |
|---|---|
| Tray Number | Source Number Assigmnent |
| 1 | 4 |
| 2 | 1 |
| 3 | 5 |

The Hewlett-Packard Laser Jet 5 has only three paper sources installed:

Source 1 (Main Paper Source)=Upper Cassette (on the Laser Jet 5, the Upper Cassette is identified as Tray 2.

Source 4 (Alternate Paper Source)=Multi-Purpose Tray (on the Laser Jet 5, the Multi-Purpose Tray is identified as Tray 1.

Source 5 (Optional Source)=Optional Lower Cassette (on the Laser Jet 5, the Optional Lower Cassette is identified as Tray 3.

The replacement Lexmark Optra S 1650 has the following source assignments for the following paper sources as listed in Table D below:

TABLE D

| Lexmark Optra S 1650 | | | | |
|---|---|---|---|---|
| Tray Number | Factory Source Number Assignment | Source Number Assignment (after MPF Renum = T2) | Source Number Assignment (after Last Tray) Renum = T3 and MPF Renum = T2) = | Renumbered Source (after Last Tray Renum = T3 and MPF Renum = T2) |
| 1 | 1 | 1 | 1 | T1 |
| 2 | 4 | 8 | 8 | MPF |
| 3 | 5 | 5 | 4 | T2 |
| MP Feeder | 8 | 4 | 5 | |

The Lexmark Optra S 1650 has the following three paper sources installed:

Source 1 (Main Paper Source)=Tray 1.

Source 4 (Alternate Paper Source)=Tray 2.

Source 8 (Tray 1–Right Side)=Multi-Purpose Feeder.

To make the Lexmark Optra S 1650 compatible with the Hewlett-Packard Laser Jet 5 using a PJL command, the multi-purpose feeder renumber is equal to Tray 2, and as a result, the source assignments for the multi-purpose feeder and Tray 2 are swapped. This swap is illustrated in the third column of Table D. Then using a PJL command, the last tray renumber is equal to Tray 3, and as a result, the source assignments for the multi-purpose feeder and Tray 3 are swapped as a result of the renumbering. Thus, requests for source number assignment 4 are converted to requests for the multi-purpose feeder and requests for source number assignment 5 are converted to requests for Tray 2.

This method of renumbering trays using Tray 1 renumber, multi-purpose feeder renumber and last tray renumber has significant drawbacks. First, there is significant complexity in swapping source number assignments using the tray renumbering assignment command. Second, not all source assignments may be changed. This can be a significant drawback if a printer has five paper sources. Third, two sources had to be swapped, that is, one source assignment could not be changed independent of other source assignments. Fourth, it is difficult to determine which source number assignments have been swapped, if a record of the source number assignments is not kept on hard copy. Given these limitations, there are situations where it is not possible to reconfigure a replacement printer's logical tray selection algorithm to meet the specification of the target printer even though sufficient physical media input sources are available.

SUMMARY OF THE INVENTION

It is, therefore, an object of the present invention to provide a new and improved method and apparatus which substantially overcomes the above-identified problems.

It is another object of the present invention to provide a method of replacing an existing printer apparatus with a replacement printer apparatus without having to change printer drivers or make custom firmware changes in external devices on a computer network.

It is yet another object of the present invention to provide a printer apparatus useable as a replacement printer which includes a map of source number assignments in the memory of the printer apparatus for a replaced printer and for the replacement printer.

It is a further object of the present invention to provide a method and apparatus in which a mapping is provided which maps one print source to another print source independent of other source assignments.

It is yet another object of the present invention in which all of the paper sources can have reassigned source number assignments.

It is yet a further object of the present invention to configure a replacement printer to be able to replace any existing printer provided that the replacement printer has at least the same number of physical media sources as the existing printer.

These and other objects of the present invention are achieved by a printing apparatus and method of use therefore. The printing apparatus is usable as a replacement printer for replacing an existing printer apparatus without having to change printer drivers or make custom changes in computers on a computer network. The inventive printer apparatus includes a map of source number assignments in the memory of the replacement printer apparatus for the replaced existing printer apparatus and for the replacement printer apparatus. The printing apparatus has a plurality of paper sources with each paper source being assigned a particular pre-assigned assignment code. The print request codes associated with the existing network printer being replaced must be determined. The print request codes are representative of a particular type of media source. A map of print request codes which are sent by computers on the network for driving the existing printer are compared with the pre-assigned source number assignment of the replacement printer. If the pre-assigned source number assignment is different for any of the paper sources than the print request code, a user can change the source number assignment to agree with the print request code. These changes are placed into a table into the non-volatile memory of the computer, thereby creating a mapping of source number assignments for the new replacement printer, the old printer being replaced, and the custom firmware. The pre-assigned source number assignments can be changed using either NPA (Network Protocol Alliance) commands, the printing apparatus operations panel or using printer job language (PJL).

The foregoing objects are achieved by a method of controlling a printing apparatus having a plurality of paper sources with each paper source having a pre-assigned source number assignment associated therewith. Print request codes to be received from an input device are determined with each print request code representative of a particular type of paper source. Each print request code is compared against each of the pre-assigned source number assignments. For each of the plurality of paper sources, if the pre-assigned source number assignment is different for the particular paper source than the print request code, the source number assignment is changed to be consistent with the print request code.

The foregoing objects are achieved by a printing apparatus having a plurality of paper sources. The printing apparatus is usable for replacing an existing printer apparatus having a plurality of paper sources. The printing apparatus has pre-assigned source number assignments associated with each of the plurality of paper sources. The existing printer apparatus has at least one different source number assignment than the replacement printing apparatus. The printing apparatus includes a map of the pre-assigned source number assignments in a memory thereof. Means for changing one or more pre-assigned source number assignments are provided in the map in the memory to agree with the different source number assignment irrespective of source number assignments.

The foregoing objects are achieved by a printing apparatus. The printing apparatus includes a processor and a memory coupled to the processor. The memory has stored therein sequences of instructions, which, when executed by the processor, cause the processor to determine print request codes to be received from an input device. Each print request code is representative of a particular type of paper source. Each print request code is compared against each of the pre-assigned source number assignments for each of the plurality of paper sources. If the pre-assigned source number assignment is different for the particular paper source than the print request code, the source number assignment is changed to be consistent with the print request code.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

A method and apparatus for mapping source number assignments according to the present invention is described. In the following description, for purposes of explanation, numerous specific details are set forth in order to provide a thorough understanding of the present invention. It will be apparent, however, that the present invention may be practiced without the specific details. In other instances, well-known structures and devices are shown in block diagram form in order to avoid unnecessarily obscuring the present invention.

Figure 1:
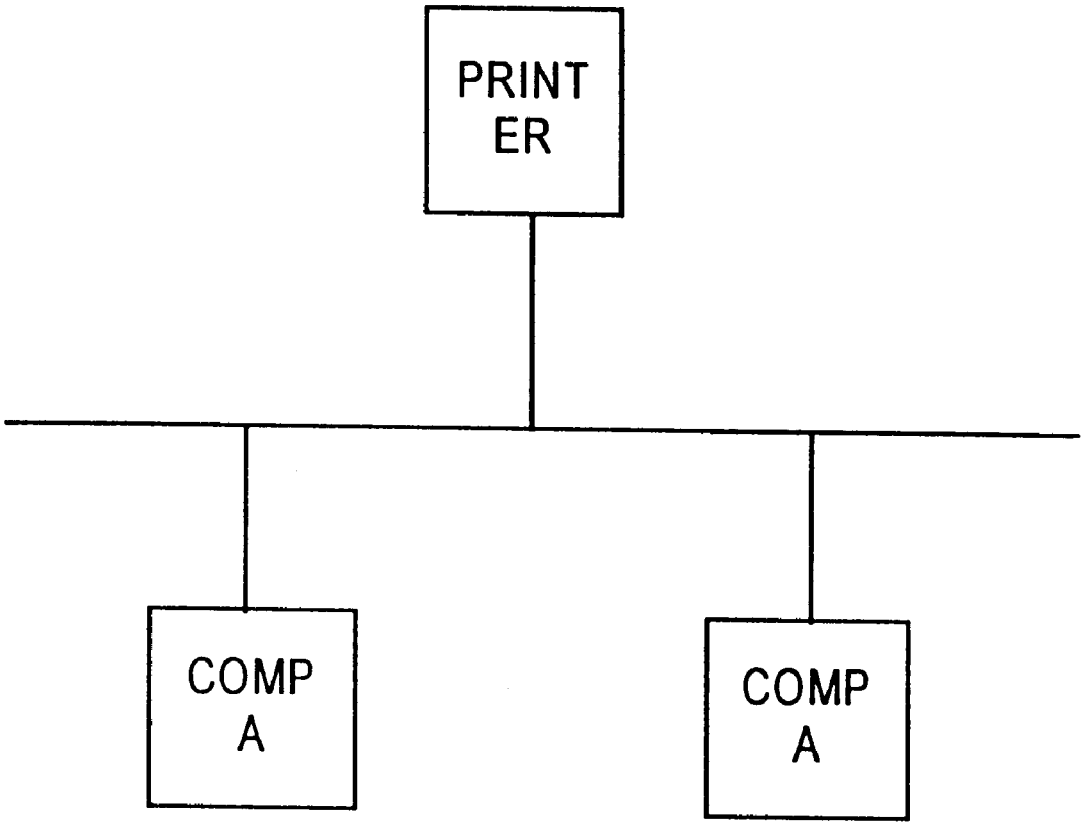
FIG. 1 is a high level illustration of a computer network.
Figure 2:
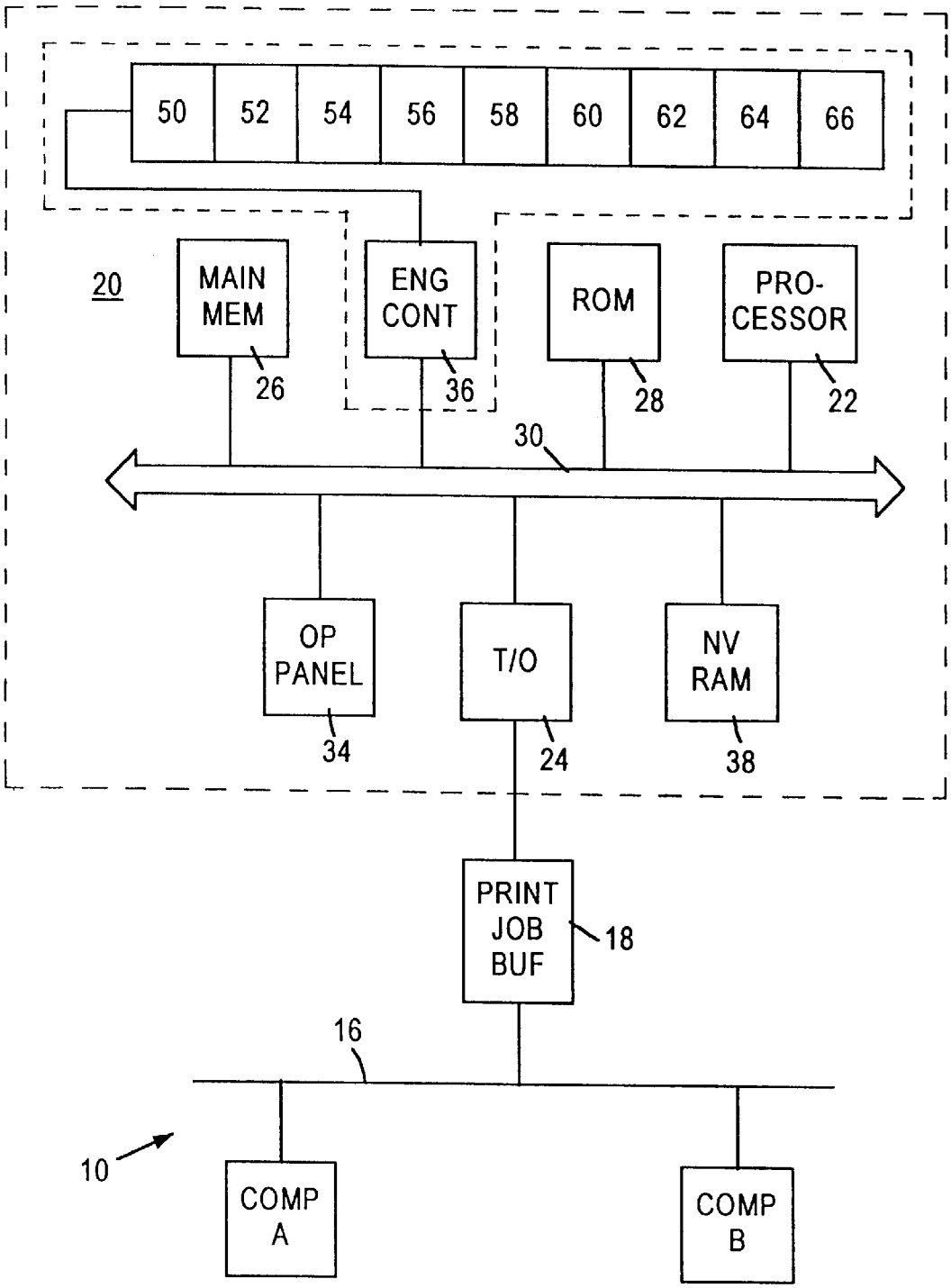
FIG. 2 is a block diagram of a printing apparatus according to the present invention connected to a computer network.
Figure 3:
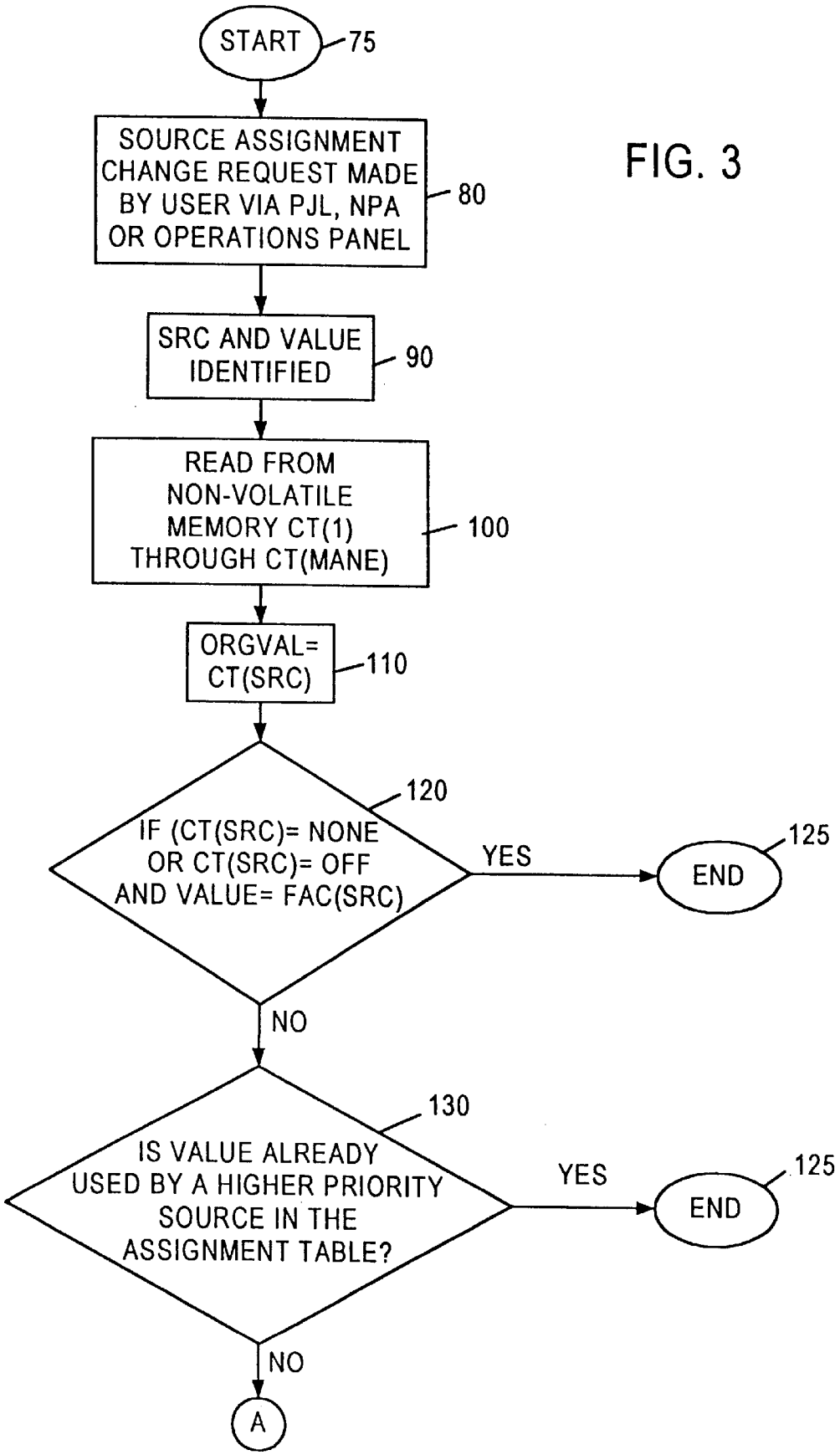
FIGS. 3–7 are flow diagrams of the method employed by the structure illustrated in FIG. 2.
Figure 4:
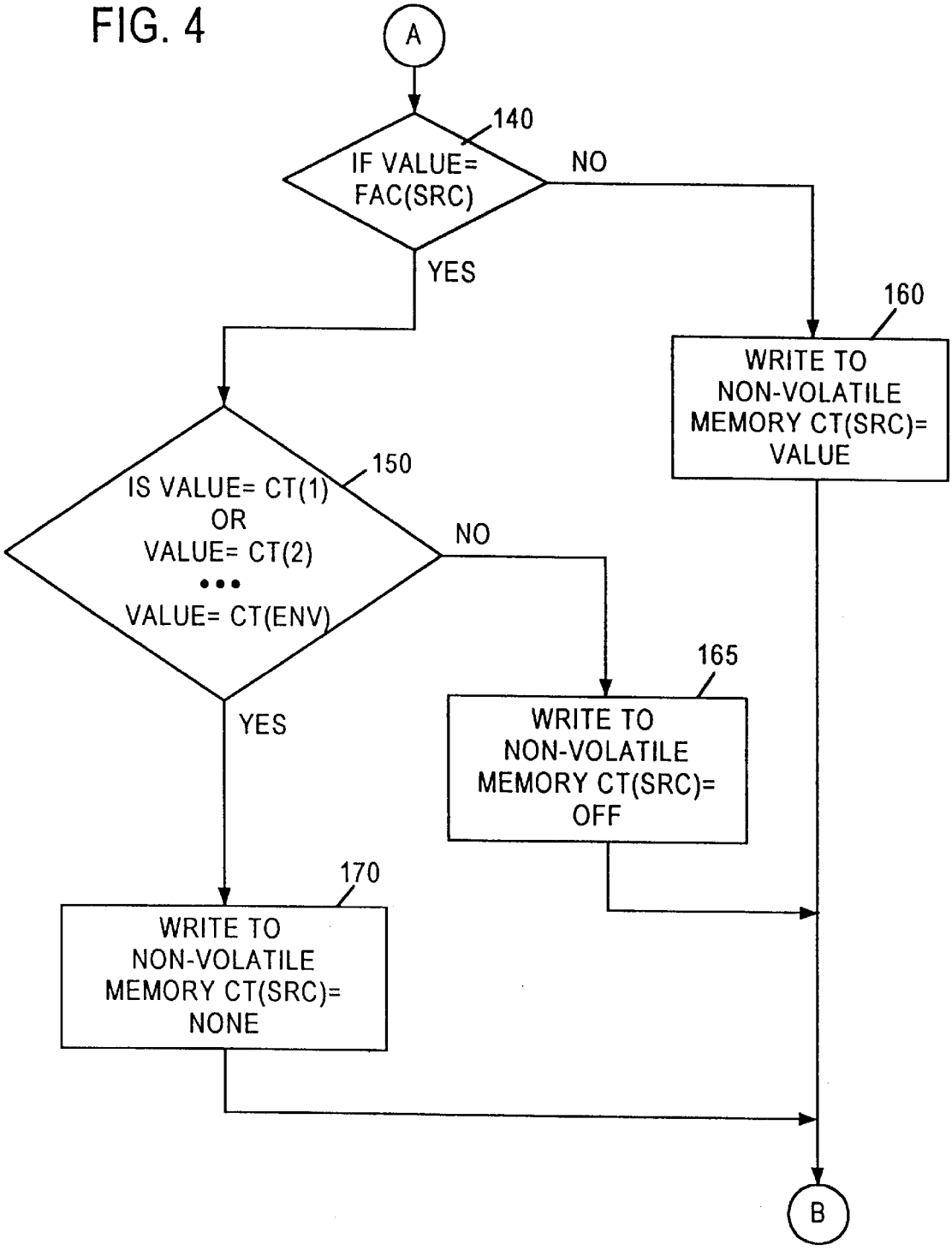
Figure 5:
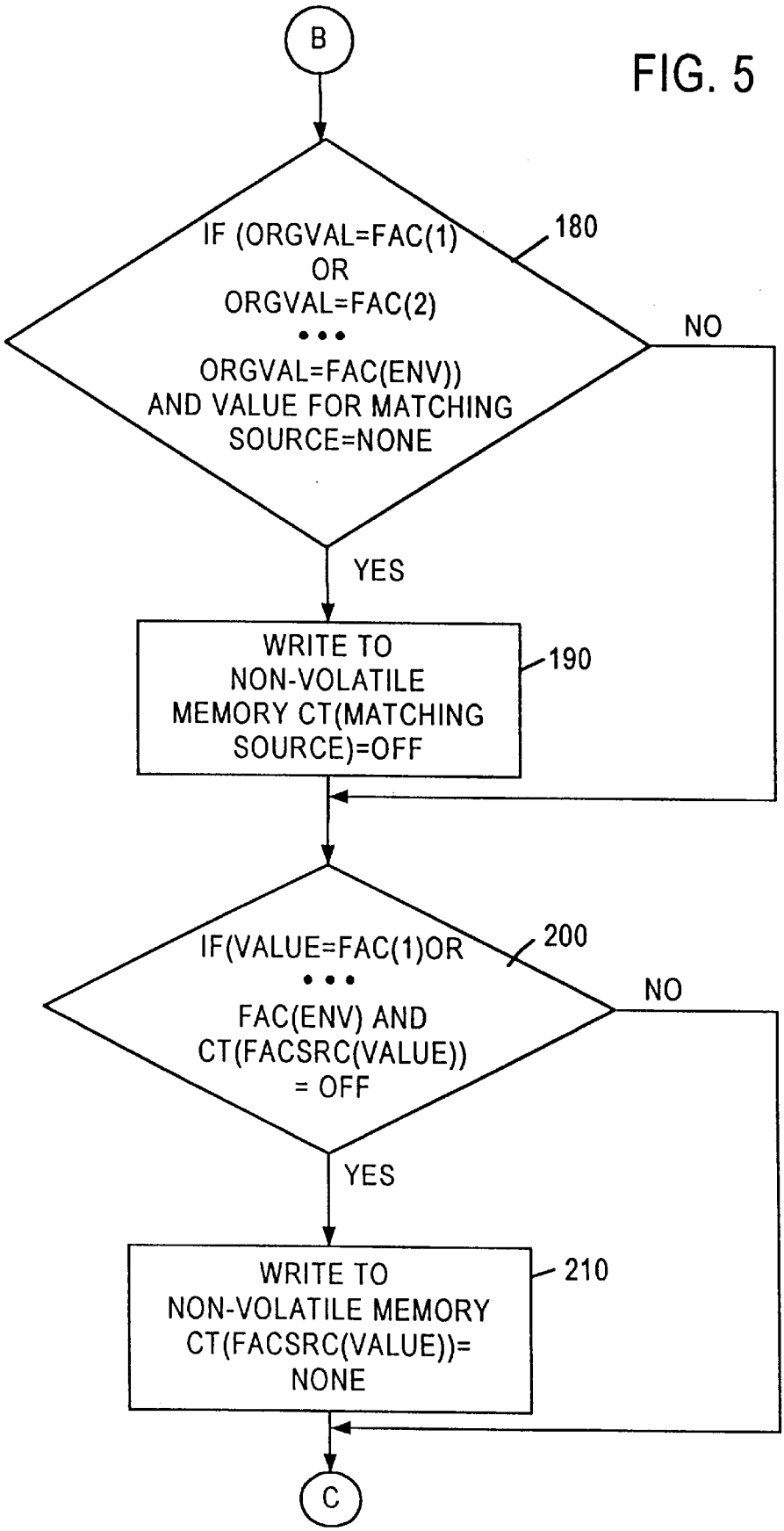
Figure 6:
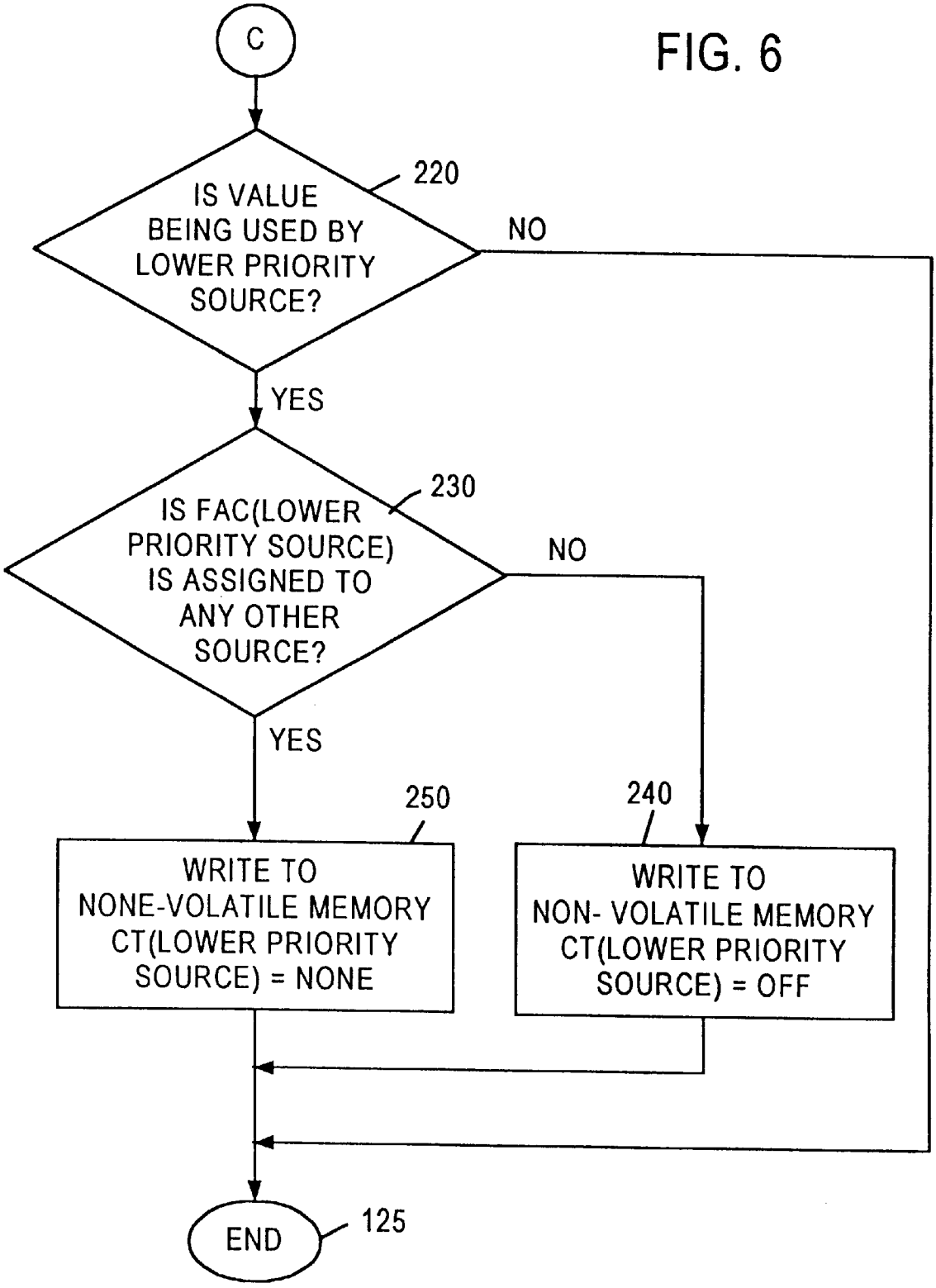

Referring now to FIG. 2, previously described computers A and B are each interconnected via a local area network (LAN) 10 or another equivalent communications network. The network devices may also include hosts, servers and personal computers. The present invention is usable on such networks as ARCnet, Ethemets and TokenRing networks, wireless networks, among other networks. The network 10 has a central network cable, 16, also known as media, which can be of any known physical configuration including unshielded or twisted pair (UTP) wire, coaxial cable, shielded or twisted pair wire, fiber optic cable, and the like. As can be appreciated, many other and additional devices can be coupled to the network including additional personal computers, mini-mainframes, mainframes and other devices not illustrated or described which are well known in the art. A printing apparatus 20 is connected via a print job buffer device 18 to the network 10. As can be appreciated, the present invention is usable with only a single computer, connected to the printer via a parallel or serial cable or other means.

Printing apparatus 20 provides print services for each of the personal computers A and B. Although the present invention is described in the context of a laser printer 20, it is to be understood that other printing devices having multiple paper sources (media sources) can also utilize the principles of the present invention. Examples of other such peripheral units are Ink Jet printers and copiers, etc. As used herein a paper source refers also to a media source.

When one of the personal computers A, B transmits a print job, that print job is communicated via media 16 to print job buffer device 18. There the print jobs are queued and are serially fed to printing apparatus 20.

Printing apparatus 20 includes a central processing unit or processor 22, an interface or input/output (I/O) module 24, a random access memory or main memory module 26 and a read-only memory (ROM) module 28 or a flash-memory containing firmware. The firmware in ROM 28 embodies a PCL interpreter specifically assigned to the analysis and interpretation of PCL commands. An operations panel 34 is also connected to bus 30 and includes a display and an input device for user modifications of source number assignments. A controller 36 is also connected to bus 30. The controller 36 is also connected to a plurality of paper sources 50–66 through a bus 48. A non-volatile memory 38 is connected to the bus 30.

For example, the plurality of paper sources 50–66 of printing apparatus 20 can include a multi-purpose feeder 50, a tray 1 (52), a tray 2 (54), a tray 3 (56), a tray 4 (58), a tray 5 (60), an envelope feeder 62, a manual paper feeder 64, and a manual envelope feeder 66. Each paper source for each printer has a particular source number assignment associated therewith.

Some definitions are necessary. As used herein, a paper source refers to a physical source of paper or media such as Tray 1, Tray 2, and Envelope Feeder. A factory source number assignment refers to the source number assignments that are pre-assigned for a paper source as shipped from a factory. The factory source number assignment is abbreviated as FAC(paper source) in the flow diagrams. A tray renumber assignment refers to a command used to change a source number assignment. The tray renumber assignment includes three fields, the paper source, the source number assignment and a value associated with the paper source. The paper source is abbreviated as SRC in the flow diagrams and value is referred to as VALUE. A print request code is a command received from a network computer (input device) for a paper source. A tray renumber setting is a renumbered source number assignment. The tray renumber assignment is abbreviated as CT(paper source) in the flow diagrams. A new source assignment is a combination of the factory source number assignment and the tray renumber setting.

Based on the foregoing definitions, a more detailed listing is provided below:

Terms:

CT(SRC) refers to the current tray renumber setting.

Each CT(SRC) will either have 1) a value; or 2) be set to off; or 3) be set to none.

1) Each value will be in the range of 0 to 199.

2) Off=Factory Assignment

3) None=No Assignment

CT(MPF)=current value of Multi-Purpose Feeder assignment stored in non-volatile memory CT(1)=current value of Tray 1 assignment stored in non-volatile memory CT(2)=current value of Tray 2 assignment stored in non-volatile memory CT(3)=current value of Tray 3 assignment stored in non-volatile memory CT(4)=current value of Tray 4 assignment stored in non-volatile memory CT(5)=current value of Tray 5 assignment stored in non-volatile memory CT(ENV)=current value of Envelope Feeder assignment stored in non-volatile memory CT(MAN)=current value of Manual Paper assignment stored in non-volatile memory CT(MANE)=current value of Manual Envelope assignment stored in non-volatile memory SRC=The source a user has requested for the assignment change. The request arrives at the printer through PJL, NPA or operations panel.

VALUE=The assignment parameter

Range: Ø–199

Off=sets the SRC assignment back to the Factory Assignment

None=does not change the current assignment

ORGVAL=CT(SRC)—the original value for the tray renumber setting is stored in memory each time the printer is powered on.

FACSRC (VAL)=Source that is associated with VAL. VAL must be one of

FAC(1) through FAC(ENV).

FAC(SRC)⇒Factory Assignment Value

FAC(MPF)⇒Factory Assignment Value for multi-purpose feeder=8

FAC(1)⇒Factory Assignment Value for Tray 1=1

FAC(2)⇒Factory Assignment Value for Tray 2=4

FAC(3)⇒Factory Assignment Value for Tray 3=5

FAC(4)⇒Factory Assignment Value for Tray 4=20

FAC(5)⇒Factory Assignment Value for Tray 5=21

FAC(ENV)⇒Factory Assignment Value for envelope feeder=6

FAC(MAN)⇒Factory Assignment Value for manual paper=2

FAC(MANE)⇒Factory Assignment Value for manual envelope=3

Using the previously provided definitions, in the present invention, the tray renumbering assignment CT(SRC) is used to change the source number assignment used by a network computer when sending a print request code to the printing apparatus 20. The print request code includes a PCL select paper feed command (<Esc>&1#H). Using the tray renumbering assignment, a user can configure a replacement printer to work with a different printer driver or custom application which uses a different set of source number assignments to request a particular paper source. The tray renumber assignments can be done using either the operations panel, NPA (Network Protocol Alliance) or using printer job language (PJL) environment variables. These assignments and the factory source number assignments are then stored in a mapping table in the non-volatile memory of the printer.

FIGS. 3–6 are flow diagrams of the steps of creating a mapping table in the non-volatile memory 38 of the printing apparatus 20 according to the present invention. At step 75, the mapping process is started by turning on the power or by initiating power on reset. At step 80, the source number requests made by a user via PJL, NPA or front operation panel 34 are read from the non-volatile RAM 38 by the processor 22.

At step 90, the tray renumber assignments including source assignment and value are identified. At step 100, the current values for tray assignments (stored as tray renumber setting CT(SRC)) are read from non-volatile memory 38. At step 110, the original value is set to be equal to the current tray renumber setting and is stored in memory 38 or a volatile memory. At step 120, if the tray renumber setting CT(SRC) equals none or the tray renumber setting CT(SRC) equals off and value equals the factory source number assignment FAC(SRC), then the process is complete at step 125. If the determination at step 120 is no, at step 130 it must be determined whether the value is already used by a higher priority source in an assignment table (an assignment table is illustrated, for example, in table 1). Sources are prioritized in the following order:

Multi-purpose Feeder

Tray 1

Tray 2

Tray 3

Tray 4

Tray 5

Envelope Feeder

Manual Paper

Manual Envelope

If the determination of step 130 is yes, then the process is complete at step 125. If the determination at step 130 is no, then it must be determined at step 140, in FIG. 4, whether the value is equal to factory source number assignment FAC(SRC). If the determination at step 140 is yes, then at step 150 it must be determined whether the value is equal to any of the tray renumber settings (CT(1) or CT(2) . . . CT(ENV)). If the determination at step 140 is no, then at step 160 the value for the tray renumber setting CT(SRC) is written to non-volatile memory 38. If the determination at step 150 is no, then the tray renumber setting CT(SRC) is written as off to non-volatile memory at step 165. If the determination at step 150 is yes, then at step 170 the tray renumber setting CT(SRC) is written as none to non-volatile memory 38. From either step 160, 165 or 170, the process proceeds to step 180, in FIG. 5, where it must be determined if the original value equals the factory source number assignment (ORGVA=FAC(1) or ORGVAL=FAC(2) or . . . ORGVAL=FAC(ENV)) and if the value for the matching source equals none. If the determination at step 180 is yes, then CT(Matching Source) equals off is written to non-volatile memory 38. If the determination at step 180 is no, then from either the no determination or step 190 the process proceeds to step 200 where it is determined if the value equals the factory source assignment value (value=FAC((1) or . . . FAC(ENV)) and CT(FACSRC) if the value equals off. If the determination at step 200 is yes, then at step 210 the tray renumber setting CT(FACSRC(value)) equals none is written to non-volatile memory 38. From either step 210 or a no determination at step 200, the process proceeds to step 220, in FIG. 6, where it is determined if the value is being used by a lower priority source. If the determination at step 220 is no, then the process is completed at step 125. If the determination at step 220 is yes, then it must be determined if the factory source assignment for the lower priority source FAC(lower priority source) is assigned to any other source at step 230. If the determination at step 230 is no, then the tray renumber setting for the lower priority source CT(lower priority source) equals off is written to non-volatile memory 38 at step 240. If the determination at step 230 is yes, then the tray renumber setting CT(lower priority source) equals none is written to non-volatile memory 38 at step 250. From either step 240 or 250, the process is then complete at step 125.

Figure 7:
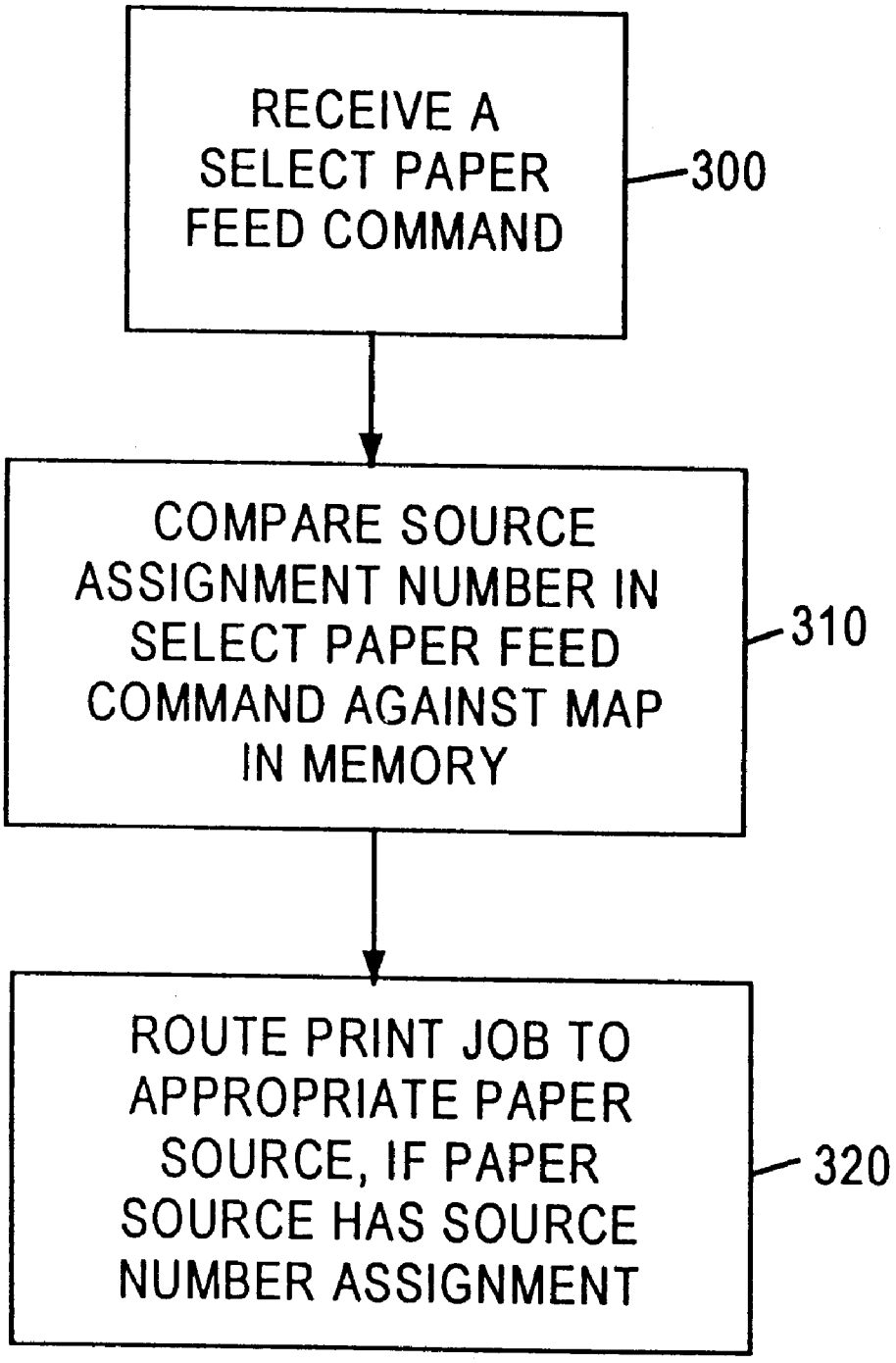

FIG. 7 is a flow diagram of the steps used in routing a select paper feed command to an appropriate paper source. At step 300 a select paper feed command is received by interface 24. The processor 22, at step 310, compares the select paper feed command against the map in main memory 26. The processor working in conjunction with controller 36, at step 320, routes the print job to the appropriate paper source, if the paper source has a source number assignment.

The method described above using FIGS. 3–6 will now be applied to four working examples. The last two examples define the boundary conditions used in the mapping process but are not typical examples of how a map would be created. The first two examples are real working examples.

EXAMPLE 1

Example 1 illustrates a source assignment that can be used to accommodate printer drivers and custom applications which may use either source number assignment 8 or source number assignment 4 to request the multi-purpose feeder. Source number assignment 4 is the factory assignment of Tray 2. This example exercises the yes path for step 200.

At step 75, the mapping process is started by turning on the power or by initiating power on reset. At step 80, the source number request is made by a user via PJL, NPA or front operation panel 34. In this example, the user has requested that the MPF be assigned a value of 4.

At step 90, the tray renumber assignments depicted in the third colitmn of Table 1 including source assignment and value are identified. At step 100, the current values for tray assignments (stored as tray renumber setting CT(SRC)) are read from non-volatile memory 38. At step 110, the original values are read from memory 38. At step 120, it is determined that the tray renumber setting CT(SRC) does not equal none and the tray renumber setting CT(SRC) does not equal off for the MPF and the value for the MPF does not equal the factory source number assignment FAC(SRC). If the determination at step 120 is no, at step 130 it is determined that the value is not already used by a higher priority source. If the determination at step 130 is no, it is determined at step 140, in FIG. 4, that the value is not equal to factory source number assignment FAC(SRC). Because the determination at step 140 is no, then at step 160 the value for the tray renumber setting CT(SRC) is written to non-volatile memory 38. From step 160, the process proceeds to step 180, in FIG. 5, where it is determined that the original value does not equal the factory source number assignment (ORGVAL=FAC(1) or ORGVAL=FAC(2) or . . . ORGVAL=FAC(ENV)) and the value for the matching source equals none. Because the determination at step 180 is no, then from the no determination the process proceeds to step 200 where it is determined that the value, 4, equals the factory source assignment value for Tray 2 and CT(Tray 2) does equal off. Because the determination at step 200 is yes, the tray renumber setting for Tray 2 is set to none and is written to non-volatile memory 38 at step 210. The process now proceeds to step 220 where it is determined that the value, 4, is not being used by a lower priority source. The process is then complete at step 125.

TABLE 1

| Sources SRC | Factory Source Number Assignments FAC(SRC) | Tray Renumber Assignments SRC and VALUE | New Source Assignments | Tray Renumber Setting CT(SRC) |
|---|---|---|---|---|
| Multi-Purpose Feeder | 8 | | 8 and 4 | 4 |
| Tray 1 | 1 | | 1 | Off |
| Tray 2 | 4 | | | None |
| Tray 3 | 5 | | 5 | Off |
| Tray 4 | 20 | Assign MPF = 4 | 20 | Off |
| Tray 5 | 21 | | 21 | Off |
| Envelope Feeder | 6 | | 6 | Off |
| Manual Paper | 2 | | 2 | Off |
| Manual Envelope | 3 | | 3 | Off |

EXAMPLE 2

Example 2 illustrates a real world example of replacing a Hewlett-Packard Laser Jet 5 with a Lexmark Optra S 1650. The Hewlett-Packard Laser Jet 5 has three paper sources installed with the following factory defined source assignments:

Tray 1=4

Tray 2=1

Tray 3=5

In the best configuration of an Optra S 1650 replacing an HP Laserjet 5, is it desirable to achieve the following tray mapping:

When the Laserjet 5 selected from Tray 1, the Optra S 1650 should select from its MPF.

When the Laserjet 5 selected from Tray 2, the Optra S 1650 should select from its Tray 1.

When the Laserjet 5 selected from Tray 3, the Optra S 1650 should select from its Tray 2.

This compatibility can be achieved using the tray renumbering capability by assigning the multi-purpose feeder equal to 4, and assigning Tray 2 equal to 5, and leaving Tray 1 at its factory default setting. Example 1 covers the case of setting the MPF to 4. The process now proceeds through the mapping process for the second assignment of Tray 2 to 5.

At step 75, the mapping process is started by turning on the power or by initiating power on reset. At step 80, the source assignment request is made by a user via PJL, NPA or front operation panel 34.

At step 90, the tray renumber assignment including source assignment, Tray 2, and value, 5, are identified. At step 100, the current values for tray assignments (stored as tray renumber setting CT(SRC)) are read from non-volatile memory 38. At step 110, the original value for Tray 2 (off) is read from memory 38. At step 120, it is determined that 5 is not the factory assignment of Tray 2. Because the determination at step 120 is no, at step 130 it is determined that the value of 5 is not already used by a higher priority source. Because the determination at step 130 is no the assignment for Tray 2 is set to 5 and this setting is written to non-volatile memory 38 in step 160. The determinations of steps 180, 200 and 220 are all no and thus the process ends at step 125.

TABLE 2

| Sources SRC | Factory Source Number Assignments FAC(SRC) | Tray Renumber Assignments SRC and VALUE | New Source Assignments | Tray Renumber Settings CT(SRC) |
|---|---|---|---|---|
| Multi-Purpose Feeder | 8 | | 8 and 4 | 4 |
| Tray 1 | 1 | | 1 | Off |
| Tray 2 | 4 | Assign MPF = 4 | 5 | 5 |
| Manual Paper | 2 | Assign T2 = 5 | 2 | Off |
| Manual Envelope | 3 | | 3 | Off |

Note: Printer drivers and custom applications may use source number 8 or source number 4 to request the Multi-Purpose Feeder, source number 1 to request Tray 1 and source number 5 to request Tray 2—same assignments used by the Laser Jet 5.

EXAMPLE 3

Example 3 illustrates the importance of prioritizing tray renumber assignments. Because two or more source assignments are unable to share the same value, the priority order of the assignments is significant. Sources are prioritized in the following order.

Multi-purpose Feeder
Tray 1
Tray 2
Tray 3
Tray 4
Tray 5
Envelope Feeder
Manual Paper
Manual Envelope In this example, 3 different sources will be assigned the same value of 5. Note that the value of 5 is the factory assignment value for Tray 3. The first assignment assigns Manual Paper a value of 5. This assignment is valid, but forces the assignment of Tray 3 to none since the value 5 is its factory assignment value and has been assigned now to the manual paper source. A similar case was covered in example 1. Setting manual paper to 5 now prepares us to test a boundary condition for the $2^{nd}$ assignment.

The $2^{nd}$ assignment assigns Tray 1 the same value of 5. Since Tray 1 is a higher priority source than Manual Paper, the assignment for Manual Paper is overridden and set back to off. This case exercised the yes path of Step 220 in FIG. 6. Tray 1 now has the assignment value of 5.

The last assignment attempted in this example is to assign Tray 4 the value of 5. This assignment is denied since the value of 5 is already used by Tray 1 which is a higher priority source than Tray 4. This case exercised the yes path of step 130.

The final results of these 3 assignments are in Table 3.

TABLE 3

| Sources SRC | Factory Source Number Assignments FAC(SRC) | Tray Renumber Assignments SRC and VALUE | New Source Assignments | Tray Renumber Setting CT(SRC) |
|---|---|---|---|---|
| Multi-Purpose Feeder | 8 | | 8 | Off |
| Tray 1 | 1 | | 1 and 5 | 5 |
| Tray 2 | 4 | | 4 | Off |
| Tray 3 | 5 | Assign Man Pap = 5; Assign T1 = 5 Assign T4 = 5 | | None |
| Tray 4 | 20 | | 20 | Off |
| Tray 5 | 21 | | 21 | Off |
| Envelope Feeder | 6 | | 6 | Off |
| Manual Paper | 2 | | 2 | Off |
| Manual Envelope | 3 | | 3 | Off |

EXAMPLE 4

Example 4 illustrates a more complex situation where a source is first assigned to one paper source and then to another. In this example, the tray renumber assignments of Tray 1=2 and Manual Paper=15 have previously been set. We now process a final assignment of Tray 3=15. This example demonstrates the determinations made in steps 220 and 230 on FIG. 6 of the flow diagram.

At step 75, the mapping process is started by turning on the power or by initiating power on reset. At step 80, the source number request made by a user via PJL, NPA or front operation panel 34 are read by the processor 22. At step 90, the tray renumber assignment including source assignment and value are identified as Tray 3 and 15 respectively. At step 100, the current values for tray assignments (stored as tray renumber setting CT(SRC)) are read from non-volatile memory 38. At step 110, the original source number assignment value for Tray 3 is read from memory 38 and stored in ORGVAL. At step 120, it is determined that the tray renumber setting CT(3) does not equal FAC(3) and the process proceeds to step 130. At step 130 it is determined that the value is not already used by a higher priority source and the process proceeds to step 140. The determinations of steps 140, 180, and 200 are all no which leads the process to step 220. Before proceeding to step 220 the source assignment for Tray 3 is set to 15 and this setting is written to non-volatile memory 38 at step 160. At step 220 the determination is yes since the value 15 is being used by the lower priority source of Manual Paper. A yes determination on step 220 takes the process to step 230. Here it is determined that FAC(MAN)=2 is already assigned to Tray 1. This determination of yes from step 230 leads to step 250 where the assignment for Manual Paper CT(lower priority source) equals none is written to non-volatile memory 38. From step 250, the process is then complete at step 125.

TABLE 4

| Sources SRC | Factory Source Number Assignments FAC(SRC) | Tray Renumber Assignments SRC and VALUE | New Source Assignments | Tray Renumber Setting CT(SRC) |
|---|---|---|---|---|
| Multi-Purpose Feeder | 8 | | 8 | Off |
| Tray 1 | 1 | | 1 and 2 | 5 |
| Tray 2 | 4 | | 4 | Off |
| Tray 3 | 5 | Assign Tray 1 = 2 | 5 and 15 | None |
| Tray 4 | 20 | Assign ManPaper = 15 | 20 | Off |
| Tray 5 | 21 | Assign Tray 3 = 15 | 21 | Off |
| Envelope Feeder | 6 | | 6 | Off |
| Manual Paper | 2 | | | None |
| Manual Envelope | 3 | | 3 | Off |

The method of the present invention can also be performed before the printing apparatus has been shipped from the factory. For example, a customer can purchase printing apparatuses pre-configured to replace a particular printer.

It should now be apparent that a method of replacing an existing printer apparatus with a replacement printer apparatus without having to change printer drivers or make custom firmware changes in external devices on a computer network has been described. It should also be apparent that a printer apparatus has been described which is useable as a replacement printer and includes a map of source number assignments in the memory of the printer apparatus for a replaced printer and for the replacement printer. Advantageously, the present invention permits all paper sources of the printing apparatus to be changed so that the replacement printer is made compatible with printer drivers and custom firmware used by computers on the computer network.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon is limited only by the definition contained in the appended claims and equivalents thereof.

What is claimed is:

1. A method of controlling a replacement printing apparatus having a plurality of paper sources, with each paper source of said replacement printing apparatus having a first pre-assigned source number assignment associated therewith, to replace an existing printing apparatus having a plurality of paper sources, with each paper source of said existing printing apparatus having a second pre-assigned source number assignment associated therewith, said existing printing apparatus having at least one different source number assignment than said replacement printing apparatus, comprising:

determining print request codes received from an input, device, each print request code representative of a particular type of paper source;

comparing each said print request code against each of said first pre-assigned source number assignments for each of the plurality of paper sources, storing a revised source number assignment changed from said first source number assignment to be consistent with said print request code.

2. The method of claim 1, comprising storing said revised source number assignments in a memory of the printing apparatus.

3. The method of claim 1, wherein the print request codes are in a printer control language (PCL).

4. The method of claim 1, comprising storing said first pre-assigned source number assignments in a memory of the printing apparatus.

5. The method of claim 4, comprising storing said revised source number assignments in a memory of the printing apparatus.

6. the method of claim 5, whereby said first pre-assigned source number assignment and said revised source number assignment is stored in a map in the memory in the printing apparatus.

7. The method of claim 1, wherein the paper sources include a tray 1, a tray 2, a tray 3, a tray 4, a tray 5, an envelope feeder, a multi-purpose feeder, a manual paper feeder and a manual envelope feeder.

8. The method of claim 1, wherein only one assignment code is changed to agree with the print request code.

9. The method of claim 1, wherein changing the assignment code is performed using an operations panel.

10. The method of claim 1, wherein changing the assignment code is performed by using NPA (Network Protocol Alliance) commands or printer job language (PJL) environment variables.

11. The method of claim 1, comprising using a tray renumber assignment command to change the pre-assigned source number assignment.

12. The method of claim 11, comprising determining whether a tray renumber assignment is already being used as a source number assignment for the printing apparatus and if the tray renumber assignment is already being used, deleting the source number assignment.

13. The method of claim 12, comprising storing the tray renumber assignments and the source number assignments in the non-volatile memory of the printing apparatus.

14. The method of claim 13, wherein each of the input devices includes one of a printer driver and custom firmware.

15. A printing apparatus having a plurality of paper sources, the printing apparatus usable for replacing an existing printer apparatus having a plurality of paper sources, the printing apparatus having pre-assigned source number assignments associated with each of the plurality of paper sources, the existing printer apparatus having at least one different source number assignment than the replacement printing apparatus, comprising:

a map of the pre-assigned source number assignments in a memory of the replacement printing apparatus;

means for changing any one or more pre-assigned source number assignments in said map in said memory to agree with the different source number assignment irrespective of source number assignments.

16. The apparatus of claim 15, wherein said means for changing changes all pre-assigned source number assignments in said map in said memory to agree with the different source number assignment irrespective of source number assignments.

17. The printing apparatus of claim 15, wherein the means for changing includes an operations panel, NPA commands, or printer job language (PJL).

18. The printing apparatus of claim 15, wherein the paper sources include a tray 1, a tray 2, a tray 3, a tray 4, a tray 5, an envelope feeder, a multi-purpose feeder, a manual paper feeder and a manual envelope feeder.

* * * * *

UNITED STATES PATENT AND TRADEMARK OFFICE

CERTIFICATE OF CORRECTION

PATENT NO : 6,027,268

DATED : February 22, 2000

INVENTOR(S) : Patrick O. Bischel, et al.

It is certified that error appears in the above-identified patent and that said Letters Patent is hereby corrected as shown below:

Column 13, line 59
Delete "," after "input"

Column 13, line 64
Insert "and" after "sources,"

Signed and Sealed this

Sixth Day of February, 2001

*Attest:*

*Attesting Officer*

Q. TODD DICKINSON

*Director of Patents and Trademarks*